US008737655B2

(12) United States Patent
Merks et al.

(10) Patent No.: US 8,737,655 B2
(45) Date of Patent: May 27, 2014

(54) SYSTEM FOR MEASURING MAXIMUM STABLE GAIN IN HEARING ASSISTANCE DEVICES

(75) Inventors: Ivo Merks, Eden Prairie, MN (US); Harikrishna P. Natarajan, Shakopee, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 996 days.

(21) Appl. No.: 12/488,129

(22) Filed: Jun. 19, 2009

(65) Prior Publication Data

US 2009/0316922 A1 Dec. 24, 2009

Related U.S. Application Data

(60) Provisional application No. 61/074,518, filed on Jun. 20, 2008.

(51) Int. Cl.
*H04R 25/00* (2006.01)

(52) U.S. Cl.
USPC ..... 381/318; 381/60; 381/312; 381/317

(58) Field of Classification Search
USPC ..... 381/314, 312, 320, 60, 316, 321, 31
See application file for complete search history.

(56) References Cited

U.S. PATENT DOCUMENTS 6,219,427 B1 * 4/2001 Kates et al. ..... 381/318
6,738,486 B2 * 5/2004 Kaulberg ..... 381/318

FOREIGN PATENT DOCUMENTS

WO WO-0110170 A2 2/2001
WO WO-2005081584 A2 9/2005

OTHER PUBLICATIONS

James M. Kates, "Feedback Cancellation in Hearing Aids: Results from a Computer Simulation", Published in: IEEE Transactions on Signal Processing, vol. 39, No. 3, Mar. 1991.*
European Application Serial No. 09163324.8, Extended European Search Report mailed Feb. 13, 2013, 11 pgs.
Fillon, Thomas, et al., "Acoustic feedback cancellation for hearing-aids, using multi-delay filter", (Oct. 4, 2002), 5 pgs.
Fillon, Thomas, "Traitement numerlque du signal acoustique pour une aide aux malentendants", Télécom ParisTech, Annulation de retour acoustique, (Dec. 14, 2004), 236 pgs.
"European Application Serial No. 09163324.8, Response filed Sep. 11, 2013 to Extended European Search Report mailed Feb. 13, 2013", 26 pgs.

* cited by examiner

*Primary Examiner* — Duc Nguyen
*Assistant Examiner* — Taunya McCarty
(74) *Attorney, Agent, or Firm* — Schwegman, Lundberg & Woessner, P.A.

(57) ABSTRACT

This disclosure relates to measurement of maximum stable gain of a hearing assistance device, including but not limited to hearing aids, as a function of frequency. In various approaches an adaptive filter with a variable step size is used to determine maximum stable gain as a function of frequency. In various approaches, the determination is done in process steps performed by the hearing assistance device. In various approaches, the determination is done in process steps performed by the hearing assistance device and by a host computer.

19 Claims, 5 Drawing Sheets

SYSTEM FOR MEASURING MAXIMUM STABLE GAIN IN HEARING ASSISTANCE DEVICES

CLAIM OF PRIORITY

The present application claims the benefit under 35 U.S.C. 119(e) of U.S. Provisional Patent Application Ser. No. 61/074,518, filed Jun. 20, 2008, which is incorporated herein by reference in its entirety.

TECHNICAL FIELD

This disclosure relates to hearing assistance devices and more particularly to measuring maximum stable gain in hearing assistance devices.

BACKGROUND

Hearing assistance devices, such as hearing aids, process sound played for a user of the device. For example, hearing aids can have programmable gain (amplification) which is adjusted to address the hearing impairment of a particular user of the hearing aid. However, excessive gain can result in acoustic feedback. Acoustic feedback is the whistling or squealing occurring when sound from the receiver of the hearing aid is received by the microphone of the hearing aid. Therefore, it is important to know how much gain can be applied before acoustic feedback occurs. This is known as "maximum stable gain." The maximum stable gain of any amplifier is typically a function of frequency. Therefore, to an audiologist or other person fitting a hearing aid to a particular user, it is valuable to have knowledge of maximum stable gain for any given band or frequency to best program the hearing aid for its wearer.

There is a need in the art for an improved system for measuring maximum stable gain in hearing assistance devices.

SUMMARY

This document provides method and apparatus for measuring maximum stable gain of hearing assistance devices, including but not limited to hearing aids, as a function of frequency. Different methods and apparatus are provided to obtain the maximum stable gain which can be used by a hearing assistance device or by a system programming that device. By performing adaptive filtering upon a circuit representing the impulse response of the hearing assistance device, the present system can calculate the maximum stable gain as a function of frequency. Various applications of the present subject matter provide an estimate of maximum stable gain with the feedback canceller operating.

In various approaches an adaptive filter with a variable step size is used to determine maximum stable gain as a function of frequency. In various applications, different types of filters are used. In various embodiments, different filters, including, but not limited to, LMS, NLMS, FIR and Wiener filters can be employed.

In various approaches, the determination is done in process steps performed by the hearing assistance device. In various approaches, the determination is done in process steps performed by the hearing assistance device and by a host computer.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their equivalents.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Figure 1:
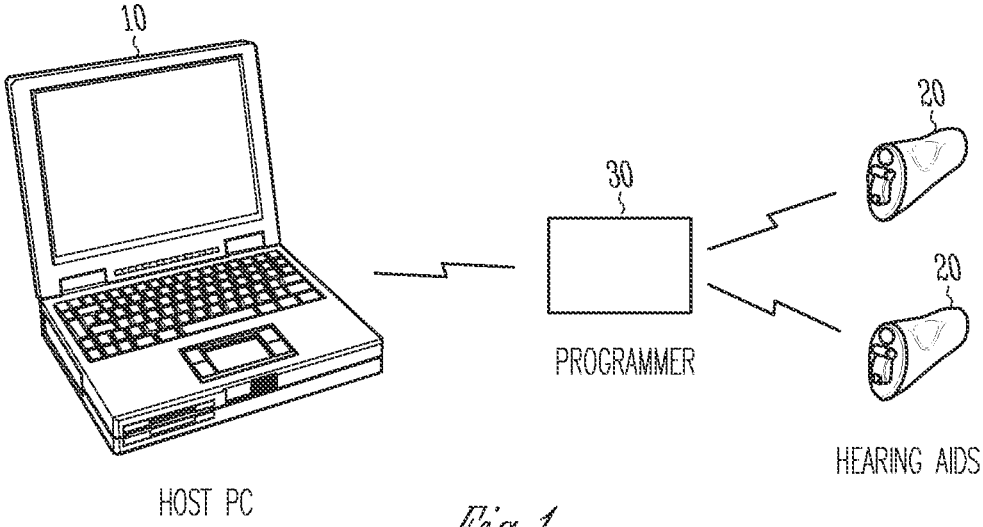
FIG. 1 is a block diagram of hearing assistance devices and programming equipment according to one embodiment of the present subject matter.

FIG. 1 is a block diagram of a pair of hearing assistance devices and programming equipment according to one embodiment of the present subject matter. FIG. 1 shows a host computer 10 in communication with the hearing assistance devices 20. In one application, the hearing assistance devices 20 are hearing aids. Other hearing assistance devices and hearing aids are possible without departing from the scope of the present subject matter. In various embodiments a programmer 30 is used to communicate with the hearing assistance devices 20, however, it is understood that the programmer functions may be embodied in the host computer 10 and/or in the hearing assistance devices 20 (e.g., hearing aids), in various embodiments. Programmer 30 thus functions to at least facilitate communications between the host computer 10 and the hearing assistance devices 20 (e.g., hearing aids), and may contain additional functionality and programming in various embodiments.

Figure 2:
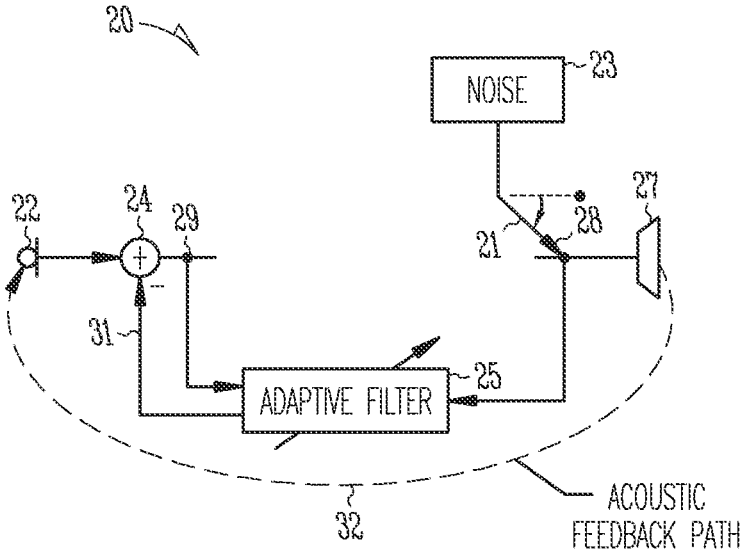
FIG. 2 is a signal flow diagram of a hearing assistance device according to one embodiment of the present subject matter.

FIG. 2 is a signal flow diagram of a hearing assistance device adapted to provide maximum stable gain measurements according to one embodiment of the present subject matter. The hearing assistance device 20 (e.g., hearing aid) is configured to programmably inject random noise into node 28 of the processing channel of the device for testing purposes in a testing mode. In this mode, gain adjustments used for hearing assistance device processing are temporarily postponed for purposes of the test. In highly programmable embodiments, noise generator 23 can be adapted to directly inject the noise into node 28. Many other configurations are possible using programmable devices such as digital signal processors. In some embodiments, the programming acts like a switch, such as switch 21 to controllably inject noise from random noise generator 23 into node 28. The signal at node 28 is ultimately passed to the speaker 27 or "receiver" in the case where the hearing assistance device 20 is a hearing aid. In the case where the hearing assistance device 20 is a hearing aid, a driver or other such amplifier may be used to amplify the output of node 28. The noise signal is the input signal of the adaptive filter 25, which has an output 31 that is subtracted from the microphone 22 signal (the "desired signal") at summer 24 and the resulting signal (also known as an "error signal") 29 is fed back to adaptive filter 25. Signal 29 is typically passed to hearing electronics (absent in this test phase) during operation of the hearing assistance device. In applications where the hearing assistance device is a hearing aid, hearing electronics include hearing aid electronics to process sound in the channel for improved listening by a wearer of the device. In digital embodiments, the device may employ a variety of analog-to-digital and digital-to-analog convertors. In various embodiments, the device may employ frequency synthesis and frequency analysis components to perform processing in the frequency domain. Combinations of the foregoing aspects are possible without departing from the scope of the present subject matter.

Although not an electrical signal, the acoustic output of the speaker 27 is acoustically coupled to the microphone to complete an acoustic feedback path 32. The adaptive filter 25 endeavors to electrically cancel the acoustic feedback path 32 in phase and amplitude as a function of frequency.

In various embodiments, the adaptive filter 25 is a least mean squares (LMS) adaptive filter. In various embodiments, the adaptive filter 25 is a normalized least mean squares (NLMS) adaptive filter. In various embodiments, the adaptive filter 25 is implemented as a time-domain finite impulse response (FIR) adaptive filter. In various embodiments, adaptive filter 25 is a frequency domain adaptive filter. In various embodiments, adaptive filter 25 is a frequency domain adaptive filter with frequency-dependent step-size control. It is understood that other types of adaptive filters may be used without departing from the scope of present subject matter. Other embodiments employing a Wiener filter approach are possible and some are demonstrated below.

Examples of Maximum Stable Gain Estimation

Several approaches may be used to estimate the maximum stable gain of a hearing assistance device. In one approach, the system of FIG. 2 is used to obtain the impulse response of the hearing assistance device by adapting the coefficients of adaptive filter 25 to cancel acoustic feedback. In this approach, the coefficients are transferred to the host computer and a program is performed which takes the coefficients and uses them to synthesize a first acoustic feedback canceller filter that emulates the one used in the target hearing assistance device design. That first acoustic feedback canceller is then prevented from further adapting and a second adaptive filter is adapted to arrive at coefficients which are used to generate the maximum stable gain as a function of frequency using equations as set forth below. This one approach is not the only approach and is only meant to be demonstrative. Other approaches and variations are possible without departing from the scope of the present subject matter.

In highly programmable designs, such as digital signal processor (DSP) designs, the DSP of a hearing assistance device can be configured to provide one or more of the switch 21, summer 24, noise generator 23, adaptive filter 25, hearing electronics (not shown), and their signal communications 28, 29, and 31. In one embodiment, the adaptive filter 25 is programmed to be a time-domain FIR filter with a number of taps that represent a combined interval of time that is large with respect to the bulk delay of the expected impulse response of the hearing assistance device 20. Switch 21 is programmed to receive white noise from noise generator 23. Any acoustic feedback canceller design that may be employed by the hearing assistance device design must be deactivated for this test. The impulse response H of the hearing assistance device is measured due to the injection of white noise by adapting the adaptive filter 25 in the presence of the white noise. In one embodiment, the adaptation is performed for about 4 seconds. Other adaptation times may be employed without departing from the scope of the present subject matter. The coefficients of the adaptive filter are representative of the impulse response and may be used for further processing as set forth herein.

In one embodiment, the host computer 10 is used to determine the maximum stable gain from the coefficients of the impulse response H. In such embodiments, the coefficients are transported to the host computer 10. Host computer 10 is adapted to emulate the signal processing demonstrated by FIGS. 3 and 4 in such embodiments.

Figure 3:
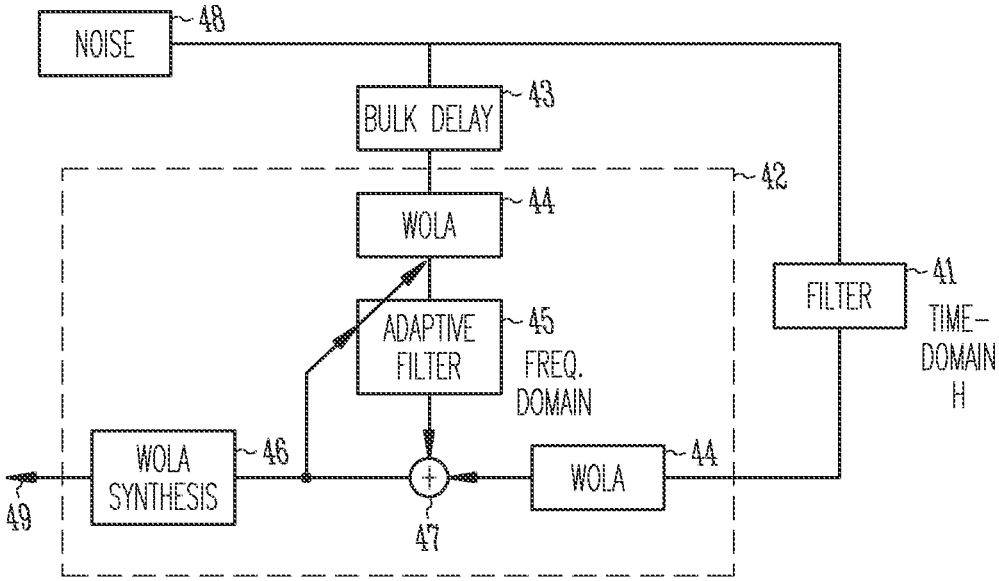
FIG. 3 is a signal flow diagram of a signal processing system including a frequency domain adaptive filter used in a process to estimate the static feedback canceller coefficients according to one embodiment of the present subject matter.

FIG. 3 is a signal flow diagram of a signal processing system including a frequency domain adaptive filter used in a process to estimate the static feedback canceller coefficients according to one embodiment of the present subject matter. When implemented in host computer 10, this system can be emulated using software. FIG. 3 shows a time-domain filter 41 with fixed coefficients of the impulse response of the hearing assistance device H, connected to a bulk delay 43, noise source 48, and a frequency-domain adaptive filter 45. The frequency-domain adaptive filter 45 is part of a frequency domain feedback canceller 42 that comprises weighted overlap-add (WOLA) time-to-frequency-domain converters 44 that convert the incoming signals to frequency domain, and a WOLA synthesis module 46 that converts the frequency-domain results back into time-domain samples at output 49. Summer 47 is used to generate a closed loop negative feedback that provides a frequency-domain feedback canceller 42 that is approximately the same as the feedback canceller ultimately employed in hearing assistance device 20. Thus, in the design of FIG. 3, filter 41 is an approximation of the transfer function of the hearing assistance device without acoustic feedback cancellation, and canceller 42 is the same design as the acoustic feedback canceller which will be employed in the hearing assistance device 20 in normal operation with the acoustic feedback canceller enabled (the "target" acoustic feedback canceller system"). Thus white noise is injected from noise source 48 and the adaptive filter 45 is allowed to run and to reach a stable solution. Once that stable solution is reached, the adaptive filter 45 is instructed to stop adapting. The parameters of the feedback canceller 42 are frozen and a second adaptive filter is added to the system, as shown in FIG. 4.

Figure 4:
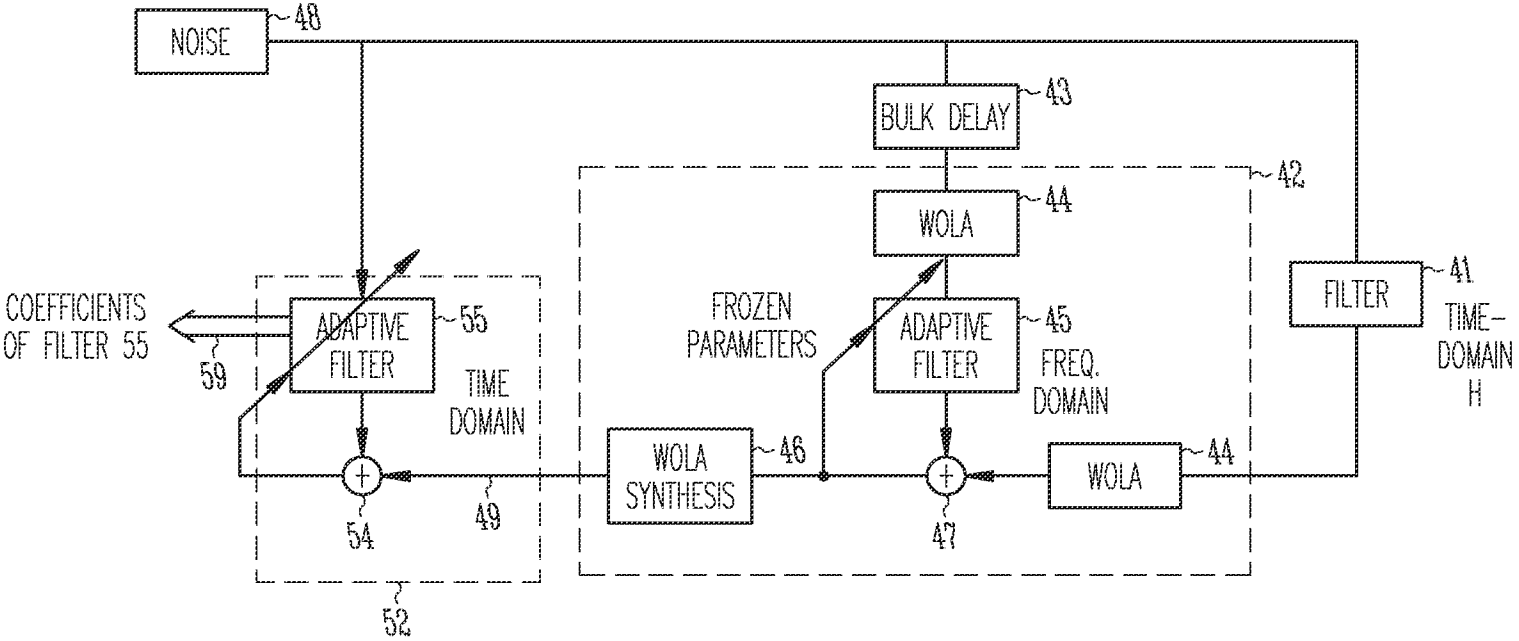
FIG. 4 is a signal flow diagram of a signal processing system including a frequency domain adaptive filter and a time domain adaptive filter used in a process to estimate maximum stable gain with feedback cancellation enabled according to one embodiment of the present subject matter.

FIG. 4 is a signal flow diagram of a signal processing system including a frequency domain adaptive filter and a time domain adaptive filter used in a process to estimate maximum stable gain with the feedback canceller enabled according to one embodiment of the present subject matter. In FIG. 4, filter 42 is not allowed to further adapt; however, noise is again injected from noise source 48 and adaptive filter 52 is allowed to adapt to a stable solution. Filter 52 is demonstrated as a time-domain adaptive filter in one embodiment; however, it is understood that in various embodiments, filter 52 may be a frequency domain adaptive filter. The coefficients 59 of adaptive filter 55 are used to generate the maximum stable gain.

Figure 5:
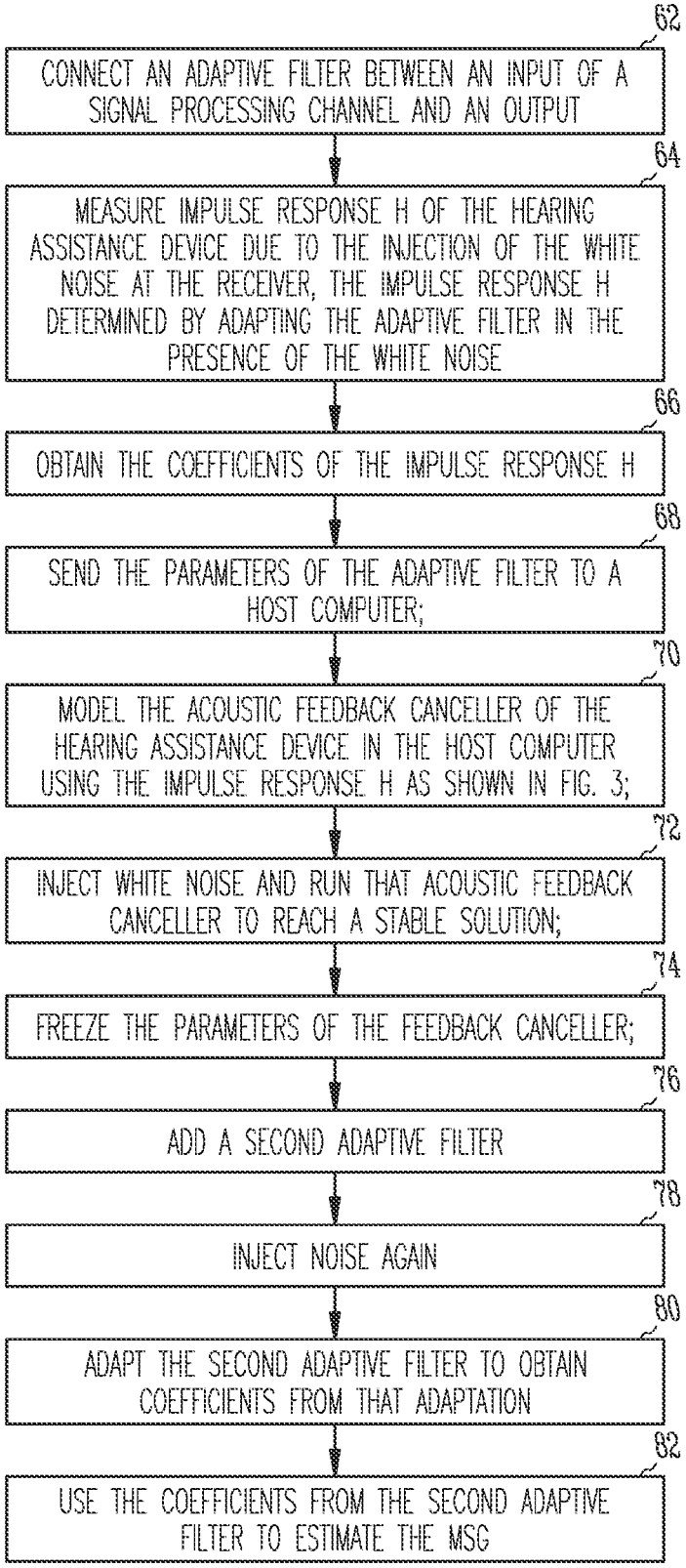
FIG. 5 is a flow diagram showing one process to obtain coefficients from a second adaptive filter to estimate the maximum stable gain, according to one embodiment of the present subject matter.

FIG. 5 is a flow diagram showing one process to obtain coefficients from a second adaptive filter to estimate the maximum stable gain, according to one embodiment of the present subject matter.

The adaptive filter 25 is connected as shown in FIG. 2, 62. A measurement of impulse response H is made by adapting the filter while injecting the noise 64. Coefficients from the adaptive filter 25 are obtained 66 and sent to the host computer 68. The acoustic feedback canceller of hearing assistance device is modeled as shown in FIG. 3, 70, and white noise is injected while the canceller is allowed to reach a solution 72. The parameters of the acoustic feedback canceller are frozen at 74. The second adaptive filter is added to the system as shown in FIG. 4 76. Noise is injected 78 and the second adaptive filter is adapted 80. The resulting coefficients are used to calculate the maximum stable gain 82 as set forth herein. In various embodiments, the calculations are performed and the maximum stable gain is displayed on a screen for visualization of the maximum stable gain curve. The curve may be presented with other data, such as prescribed gain curves and/or with current or desired gain settings. Other processes and procedures are possible without departing from the scope of the present subject matter.

Calculations of the maximum stable gain are demonstrated as follows. The hearing assistance device becomes unstable when, $$|F(f)G(f)|=>1 \text{ and } \angle Z(f)G(f)=n2\pi$$

where F(f) is the feedback path as function of the frequency, G(f) is the gain of the hearing assistance device, and n is an integer value. Because of the delay in the hearing assistance device, the condition on the phase is almost always true (there will be zero crossing every 100 Hz for a delay of 4 milliseconds) and it is therefore assumed that this is always true (a possible "worst-case" scenario).

The maximum stable gain (MSG) in dB (decibels) of a hearing assistance device can then be calculated as $$MSGoff(f) = 20\log10\left(\left|\frac{1}{F(f)}\right|\right) \quad [1]$$

This is the maximum stable gain with the FBC (feedback canceller) 42 off. Thus, in this case the denominator F(f) is derived from the coefficients of filter 41 (H). If the FBC 42 is on and the estimate of the feedback path in the adaptive filter 42 (derived from the coefficients of filter 45) is $\hat{F}(f)$, then the MSG in dB with FBC on is:

$$MSGon(f) = 20\log10\left(\left|\frac{1}{F(f)-\hat{F}(f)}\right|\right) \quad [2]$$

Because F(f) and $\hat{F}(f)$ are not necessarily in the same domain, the coefficients 59 from the second adaptive filter 55, the Residue Impulse Response, or Hresidue, are used to estimate the MSG with FBC on. The maximum stable gain can be calculated using Equation [1].

In one embodiment, "MSG off" is calculated as follows:

Do a fast Fourier transform (FFT) of the H coefficients (filter 41). This can be done with the microphone in a directional or omnidirectional mode;

Calculate MSG as a function of frequency using equation [1];

For display purposes, the MSG can be limited to the limits of the display. Typical limits could be 0 and 100 dB (This procedure is optional);

In normal operation, the hearing assistance device might have a correction for the specific receiver characteristics and if this correction is not present during the FBC initialization, the MSG needs to be corrected. (This procedure is optional.) Such a correction can include:

- decimating amount of bins to the number of bands of the frequency correction in the hearing aid by taking minimum of the band;
- subtracting the correction mentioned above from the MSG; and
- interpolating the corrected MSG to the desired frequency range.

In one embodiment "MSG on" is calculated as follows:

Do a FFT of final NLMS coefficients of the second adaptive filter 55,

Calculate MSG using equation [1];

The same optional post-processing steps relating to corrections for display and for correction of specific receiver characteristic for the MSG with FBC off (above) can also be optionally done on the MSG for FBC on.

The above steps referring to "taking the minimum of the band" assume that every frequency bin is only affected by one WOLA-band during amplification. This is of course not true. Every frequency bin depends on several WOLA-bands, but taking the minimum of the band is a conservative approach provided that the displayed gain in the fitting software takes the dependencies between the WOLA-bands into account.

The result is the MSG as a function of frequency, which can be displayed to an audiologist or other user and used for programming the device.

Although this process was described as being performed in a host computer, it is possible in alternative embodiments to perform the processing within the programmer and within the hearing assistance device itself. In such embodiments, the host computer can optionally receive maximum stable gain information as a function of frequency to display as needed by an audiologist or other user. In embodiments where the maximum stable gain is calculated completely by the hearing assistance device, the device may use the maximum stable gain to limit or otherwise control operation of the device without another visit to an audiologist's office.

For embodiments where one or more process steps are performed on a host computer, the circuit representing the impulse response of the hearing assistance device is a filter with the coefficients obtained from adapting filter 25, such as filter 41. It is understood that such a circuit representing the impulse response may be generated in software, firmware, or hardware. Thus, in systems using software or firmware to model the filter the circuit representing impulse response may be realized in software or firmware, and need not be a separate hardware circuit component. For embodiments where the process steps are primarily performed by the hearing assistance device the circuit representing the impulse response of the hearing assistance device is the hearing assistance device itself.

The accuracy of the MSG (especially with FBC on) will depend on the level of the stimulus (noise), the MSG and the background noise. The MSG is inverse proportional to the (residual) feedback and the level of the (residual) feedback is proportional to the level of the stimulus minus the MSG. If this level is close to the level of the background noise, the MSG estimate will be less accurate.

Figure 6:
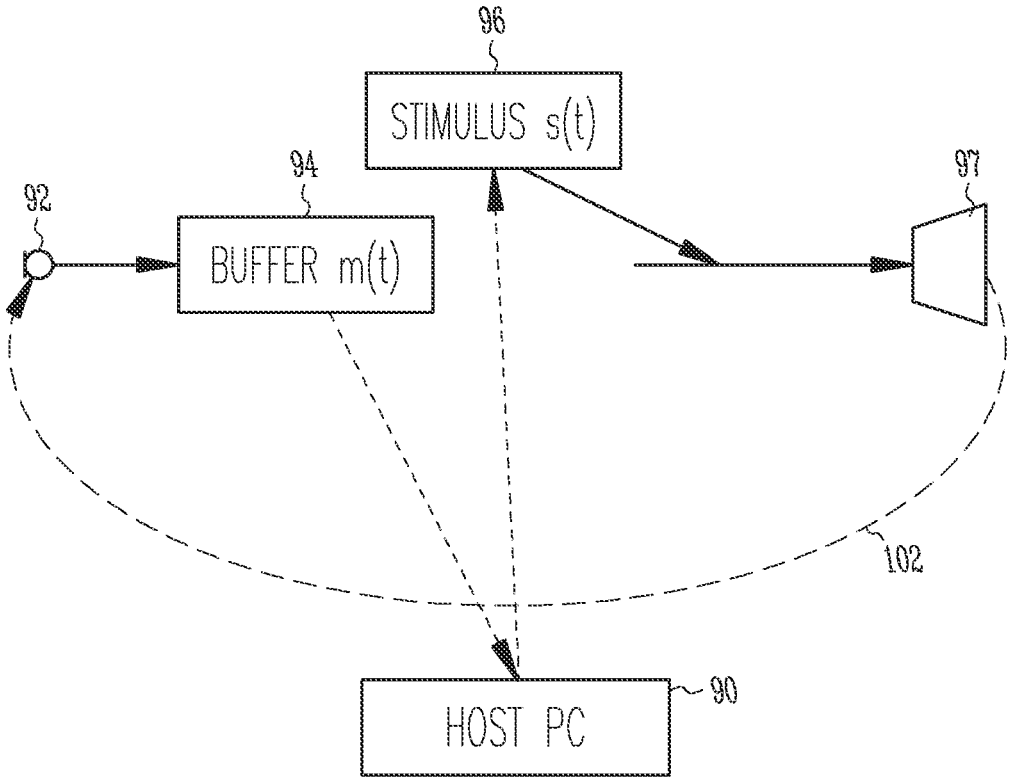
FIG. 6 is a signal flow diagram of a hearing assistance device system according to one embodiment of the present subject matter.

One way to solve this accuracy problem is to use a Wiener filter instead of an adaptive filter 25. One example is shown in FIG. 6, where the host computer system 90 (or host PC) sends a stimulus 96 to a hearing assistance device. In one embodiment, the stimulus 96 would be a signal s(t) with a length that is a few times larger than the length of the acoustic feedback path 102, and the stimulus 96 is played a number of times by speaker 97. A signal m(t) from microphone 92 is averaged with the same length as the original stimulus, in an embodiment. After acquisition of the (averaged) microphone signal m(t) by buffer 94, it is sent to the host PC 90. From the stimulus signal s(t) and the microphone signal m(t), the impulse response is calculated using a Wiener filter (see for example Chapter 5 of *Adaptive Filter Theory*, Simon Haykin, 1996, Prentice-Hall, Inc.). For efficiency reasons, it is easier to perform this calculation in the frequency domain. The feedback path F(f) is calculated as:

$$F(f) = \frac{M(f)S^*(f)}{S(f)S^*(f)},$$

where S(f)=FFT(s(t)) and M(f)=FFT(m(t)), where FFT is the Fast Fourier Transform. The stimulus signal can be white noise, MLS noise, pure tone sweep or complex tone, in various embodiments. Although this example shows the calculation being done on the host PC 90, the calculation can be done on the host or in the firmware.

Another way to solve the accuracy problem is to use an adaptive filter 25 with step-size control. Step-size control is used in applications as acoustic echo cancellation to improve echo cancellation during double talk or background noise (see *Step-Size Control for Acoustic Echo Cancellation Filters—An Overview*, by Andreas Mader, Henning Pruder, and Gerhard Uwe Schmidt, Signal Processing, Vol. 80, Issue 9, September 2000, Pp. 1697-1719). The update rule of an adaptive filter is proportional to the error signal: the adaptive filter will diverge, if the desired signal (microphone signal) contains a relatively large amount of background noise. Step-size control reduces the step-size when background noise is present.

The update rule of an NLMS filter is as follows: w[n+1] =w[n]+μ*e*x/P, where μ is the step-size parameter, e is the error signal, x is the input signal, w[n+1] is a new coefficient value, w[n] is the present coefficient value, and P is the normalization power. Normally, the normalization power is P=x*x+C, where C is a regularization constant (to avoid division by 0). By choosing a different normalization power, step-size control can be made possible.

One choice for normalization power is P=x*x+e*e*K+C, where K is a parameter which is the inverse of the energy of the impulse response. If there is a lot of background noise, the second term of the normalization power will be large resulting in a smaller step-size.

The update rule of an adaptive filter is also proportional to the step-size parameter μ. The value of μ is a trade-off between fast convergence and low excess error (see for example Haykin, *Adaptive Filter Theory*). For the estimation of the acoustic feedback path, the step-size should be fast at the beginning (for fast convergence) and slow at the end (for low excess error). This step-size could be set to decrease as function of time or the step-size could be set according to the convergence according to methods described in Mader et al., 2000

The aforementioned step-size control can be done for time-domain as well as frequency-domain adaptive filters. The advantage of frequency-domain adaptive filter is that each frequency can have its own step-size control. This is advantageous, because, the relative background noise level (to the residual feedback level) is frequency dependent. However it is still fairly consistent across subjects, so that it can be determined once in advance.

In various embodiments, the present subject matter provides a maximum stable gain measurement system for a hearing assistance device, the hearing assistance device having an impulse response including: a white noise generator to produce a white noise signal; a first adaptive filter programmed to adapt during an injection of the white noise signal into a circuit representing the impulse response; and a second adaptive filter connected in parallel with the first adaptive filter, the second adaptive filter programmed to adapt during a second injection of the white noise by the white noise generator to determine a second impulse response, which is used to produce maximum stable gain (MSG) as a function of frequency of the hearing assistance device. Systems using LMS, NLMS, FIR, and Wiener filters can be used to produce the circuit representing the impulse response. In various embodiments, the circuit representing the impulse response is generated with a filter having step-size control. Embodiments having time domain and frequency domain approaches for the different adaptive filters are provided. The present subject matter is especially useful in applications wherein the hearing assistance device is a hearing aid.

The present subject matter also provides, among other things, a method for measuring maximum stable gain for a hearing assistance device, including: injecting noise at a receiver of the hearing assistance device; measuring an impulse response of the hearing assistance device using a first adaptive filter connected between an input of a signal processing channel of the hearing assistance device and an output of the hearing assistance device; modeling acoustic feedback cancellation of the hearing assistance device using the measured impulse response; adapting coefficients for a second adaptive filter during a second injection of noise; and using the coefficients from the second adaptive filter to estimate maximum stable gain (MSG) for the hearing assistance device. Different applications are described wherein modeling acoustic feedback cancellation includes using a host computer in communication with the hearing assistance device or within the hearing assistance device itself. In some embodiments using the coefficients to estimate the MSG includes computing a Fourier transform. Various approaches employ a Wiener filter to determine the impulse response of the hearing assistance device. Various approaches use filters with step-size control. Other variations as claimed are set forth herein.

The present subject matter also provides embodiments for a maximum stable gain measurement system for a hearing assistance device, including: a microphone connected to convert received sound into a signal; a processing channel adapted to process the signal and provide an output signal to an output node, the processing channel comprising: a white noise generator programmed to provide a white noise signal to the output node which is played by the receiver; and an adaptive filter having step-size control, the adaptive filter including a first input sampled from the output node and a second input sampled from a subtraction of an output of the adaptive filter and the signal from the microphone; and a receiver connected to the output node and adapted to play signals at the output node, wherein the processing channel is programmed to adapt the adaptive filter using step-size control during injection of the white noise signal in a first mode of operation and to stop adaptation of coefficients in a second mode of operation.

In various embodiments the system further includes a bulk delay adapted to receive a white noise signal; and an acoustic feedback canceller connected to the bulk delay and to a filter using the coefficients of the adaptive filter, the filter connected to receive the white noise signal, the acoustic feedback canceller programmed to adapt during an injection of the white noise signal into the filter and the bulk delay in a third mode of operation and to freeze the parameters of the acoustic feedback canceller in a fourth mode of operation.

In various embodiments the system further includes a second adaptive filter connected in parallel with the acoustic feedback canceller and the filter, the second adaptive filter programmed to adapt during an injection of the white noise into the second adaptive filter, the filter, and the acoustic feedback canceller in a fifth mode of operation, wherein the coefficients of the second adaptive filter are used to produce a maximum stable gain (MSG) of the hearing assistance device.

Various filters including, but not limited to LMS, NMLS, FIR, and Wiener filters can be used for the adaptive filter. It is understood that various frequency domain and time domain approaches are possible.

In various embodiments the present subject matter also provides a method for measuring maximum stable gain for a hearing assistance device, including: injecting noise at a receiver of the hearing assistance device; measuring an impulse response of the hearing assistance device using a first adaptive filter including step-size control connected between an input of a signal processing channel of the hearing assistance device and an output of the hearing assistance device; modeling acoustic feedback cancellation using a second adaptive filter and bulk delay in parallel with a filter using the measured impulse response, the modeling performed by injecting noise into the bulk delay and the filter and adapting coefficients of the second adaptive filter; freezing the coefficients of the second adaptive filter; adapting coefficients of a third adaptive filter in parallel with the filter and the second adaptive filter and bulk delay during another injection of noise; and estimating maximum stable gain (MSG) for the hearing assistance device using the coefficients of the third adaptive filter. Various approaches for the calculation of the parameters/coefficients may be used including, but not limited to, the use of a host computer and/or other processing on the hearing assistance device. Various embodiments exist wherein the first adaptive filter is a frequency domain filter, and the step-size control is performed for each frequency subband of the first adaptive filter. Various embodiments include wherein the first adaptive filter is a frequency domain filter, and the step-size control is performed with a fast step-size adjustment followed by a slower step-size adjustment.

The present subject matter includes hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A maximum stable gain measurement system for a hearing assistance device, comprising:

a microphone connected to convert received sound into a signal;

a receiver configured to play sound;

a processing channel adapted to process the signal and provide an output signal to an output node, the processing channel comprising:

a white noise generator programmed to provide a white noise signal to the output node which is played by the receiver; and an adaptive filter having step-size control, the adaptive filter including a first input sampled from the output node and a second input sampled from a subtraction of an output of the adaptive filter and the signal from the microphone; and wherein the receiver is connected to the output node adapted to play signals at the output node, wherein the processing channel is programmed to adapt the adaptive filter using step-size control during injection of the white noise signal in a first mode of operation and to stop adaptation of coefficients in a second mode of operation;

a bulk delay adapted to receive a white noise signal; and an acoustic feedback canceller connected to the bulk delay and to a time-domain filter using the coefficients of the adaptive filter, the time-domain filter connected to receive the white noise signal, the acoustic feedback canceller programmed to adapt during an injection of the white noise signal into the time-domain filter and the bulk delay in a third mode of operation and to freeze the parameters of the acoustic feedback canceller in a fourth mode of operation.

2. The system of claim 1, further comprising a second adaptive filter connected in parallel with the acoustic feedback canceller and the time-domain filter, the second adaptive filter programmed to adapt during an injection of the white noise into the second adaptive filter, the time-domain filter, and the acoustic feedback canceller in a fifth mode of operation, wherein the coefficients of the second adaptive filter are used to produce a maximum stable gain (MSG) of the hearing assistance device.

3. The system of claim 1, wherein the adaptive filter is a least mean squares (LMS) adaptive filter.

4. The system of claim 1, wherein the adaptive filter is a normalized least mean squares (NLMS) adaptive filter.

5. The system of claim 1, wherein the adaptive filter is a finite impulse response (FIR) adaptive filter.

6. The system of claim 1, wherein the adaptive filter is a Wiener adaptive filter.

7. The system of claim 1, wherein the adaptive filter is a frequency domain adaptive filter.

8. The system of claim 1, wherein the acoustic feedback canceller includes a frequency domain adaptive filter.

9. The system claim 1, wherein the hearing assistance device is a hearing aid.

10. A method for measuring maximum stable gain for a hearing assistance device, comprising:

injecting noise at a receiver of the hearing assistance device;

measuring an impulse response of the hearing assistance device using a first adaptive filter including step-size control connected between an input of a signal processing channel of the hearing assistance device and an output of the hearing assistance device;

modeling acoustic feedback cancellation using a second adaptive filter and bulk delay in parallel with a time-domain filter using the measured impulse response, the modeling performed by injecting noise into the bulk delay and the time-domain filter and adapting coefficients of the second adaptive filter;

freezing the coefficients of the second adaptive filter;

adapting coefficients of a third adaptive filter in parallel with the time-domain filter and the second adaptive filter and bulk delay during another injection of noise; and estimating maximum stable gain (MSG) for the hearing assistance device using the coefficients of the third adaptive filter.

11. The method of claim 10, wherein modeling acoustic feedback cancellation is performed using a host computer in communication with the hearing assistance device.

12. The method of claim 10, wherein adapting coefficients of a third adaptive filter is performed using a host computer in communication with the hearing assistance device.

13. The method of claim 10, wherein estimating the maximum stable gain includes computing a Fourier transform.

14. The method of claim 10, wherein the first adaptive filter is a least mean squares (LMS) adaptive filter.

15. The method of claim 10, wherein the first adaptive filter is a normalized least mean squares (NLMS) adaptive filter.

16. The method of claim 10, wherein the first adaptive filter is a finite impulse response (FIR) adaptive filter.

17. The method of claim 10, wherein the first adaptive filter is a Wiener adaptive filter.

18. The method of claim 10, wherein the first adaptive filter is a frequency domain filter, and the step-size control is performed for each frequency subband of the first adaptive filter.

19. The method of claim 10, wherein the first adaptive filter is a frequency domain filter, and the step-size control is performed with a fast step-size adjustment followed by a slower step-size adjustment.

* * * * *

UNITED STATES PATENT AND TRADEMARK OFFICE

CERTIFICATE OF CORRECTION

PATENT NO. : 8,737,655 B2
APPLICATION NO. : 12/488129
DATED : May 27, 2014
INVENTOR(S) : Merks et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1210 days.

Signed and Sealed this
Eleventh Day of August, 2015

Michelle K. Lee

Michelle K. Lee
*Director of the United States Patent and Trademark Office*